US008966671B2

(12) United States Patent
Rumbaugh

(10) Patent No.: US 8,966,671 B2
(45) Date of Patent: Mar. 3, 2015

(54) SPORTING HELMET WITH OUTER PADS

(76) Inventor: Garry Rumbaugh, Westminster, MD (US)

( * ) Notice: Subject to any disclaimer, the term of this patent is extended or adjusted under 35 U.S.C. 154(b) by 0 days.

(21) Appl. No.: 13/329,160

(22) Filed: Dec. 16, 2011

(65) Prior Publication Data

US 2012/0151663 A1 Jun. 21, 2012

Related U.S. Application Data

(60) Provisional application No. 61/424,324, filed on Dec. 17, 2010.

(51) Int. Cl.
*A42B 3/00* (2006.01)
*A42B 3/06* (2006.01)

(52) U.S. Cl.
CPC ..... *A42B 3/065* (2013.01); *A42B 3/003* (2013.01); *A42B 3/063* (2013.01)
USPC ..... 2/412; 2/410; 2/411

(58) Field of Classification Search
CPC ..... A42B 1/12; A63B 33/00
USPC ..... 2/411, 459, 463, 464, 465, 467, 6.8, 2/416, 422, 425, 22, 24, 5, 6.1, 6.2, 6.4, 2/6.6, 7, 8.1, 8.2, 410, 412
See application file for complete search history.

(56) References Cited

U.S. PATENT DOCUMENTS

| | | | | |
|---|---|---|---|---|
| 4,134,155 | A * | 1/1979 | Robertson | 2/412 |
| 4,937,888 | A * | 7/1990 | Straus | 2/411 |
| 5,309,576 | A * | 5/1994 | Broersma | 2/412 |
| 5,940,889 | A * | 8/1999 | Shirai | 2/411 |
| 6,272,692 | B1 * | 8/2001 | Abraham | 2/411 |
| 2003/0140400 | A1 * | 7/2003 | Ho | 2/411 |
| 2007/0157370 | A1 * | 7/2007 | Joubert Des Ouches | 2/410 |
| 2008/0201813 | A1 * | 8/2008 | Yang | 2/7 |
| 2012/0317705 | A1 * | 12/2012 | Lindsay | 2/413 |

* cited by examiner

*Primary Examiner* — Khoa Huynh
*Assistant Examiner* — Khaled Annis

(57) ABSTRACT

A sports helmet includes recessed insert surfaces on its exterior to accommodate shock absorbing inserts disposed therein. The helmet may include, for example, five recessed insert surfaces, a front recessed surface, a top recessed surface, a rear recessed surface, and two side recessed surfaces. The inserts may be disposed into the recessed surfaces to create a substantially uniform outer helmet shape. A uniform finish may cover the exterior of the helmet. The shock absorbing inserts, when used on a person receiving a force to the helmet's insert, will absorb at least a portion of the force, limiting the force's impact on the wearer's brain. The helmet may, for example, help prevent concussions and other brain injuries in sport participants.

6 Claims, 3 Drawing Sheets

SPORTING HELMET WITH OUTER PADS

CROSS-REFERENCE TO RELATED APPLICATIONS

This application claims the benefit of priority of U.S. provisional application No. 61/424,324, filed Dec. 17, 2010, the contents of which are herein incorporated by reference.

BACKGROUND OF THE INVENTION

The present invention relates to sporting helmets and, more particularly, to a sporting helmet with flexible recessed inserts to help prevent concussions.

For every action, there is an equal and opposite reaction. Thus, when someone is hit on a helmet, the brain, which is incased in fluid, is pushed to the skull. The hard external surface of a helmet does not absorb any force applied to the helmet. Instead, this force is transmitted into the helmet. While current sports helmets have an internal padding system, this padding system does not prevent concussions.

As can be seen, there is a need for an improved helmet that may absorb the force of an impact on the helmet.

SUMMARY OF THE INVENTION

In one aspect of the present invention, a helmet comprises at least one recessed insert surface formed on an exterior of the helmet; at least one insert adapted to fit into the recessed insert surface; and an outer finish adapted to cover the exterior of the helmet when the insert is disposed in the recessed insert surface.

In another aspect of the present invention, a helmet comprises a front insert disposed in a front recessed insert surface; a top insert disposed in a top recessed insert surface; a left side insert disposed in a left side recessed insert surface; a right side insert disposed in a right side recessed insert surface; a back insert disposed in a back recessed insert surface; and a smooth outer surface covering an exterior of the helmet.

In a further aspect of the present invention, a method for reducing the potential for injury from a head blow while playing sports comprises fitting players with a helmet, the helmet having a plurality of inserts disposed in a plurality of recessed insert surfaces and an outer surface covering an exterior of the helmet; and absorbing at least a portion of the head blow with one of the plurality of inserts.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a sports helmet that includes recessed insert surfaces on its exterior to accommodate shock absorbing inserts disposed therein. The helmet may include, for example, five recessed insert surfaces, a front recessed surface, a top recessed surface, a rear recessed surface, and two side recessed surfaces. The inserts may be disposed into the recessed surfaces to create a substantially uniform outer helmet shape. A uniform finish may cover the exterior of the helmet. The shock absorbing inserts, when used on a person receiving a force to the helmet's insert, will absorb at least a portion of the force, limiting the force's impact on the wearer's brain. The helmet may, for example, help prevent concussions and other brain injuries in sport participants.

Figure 1:
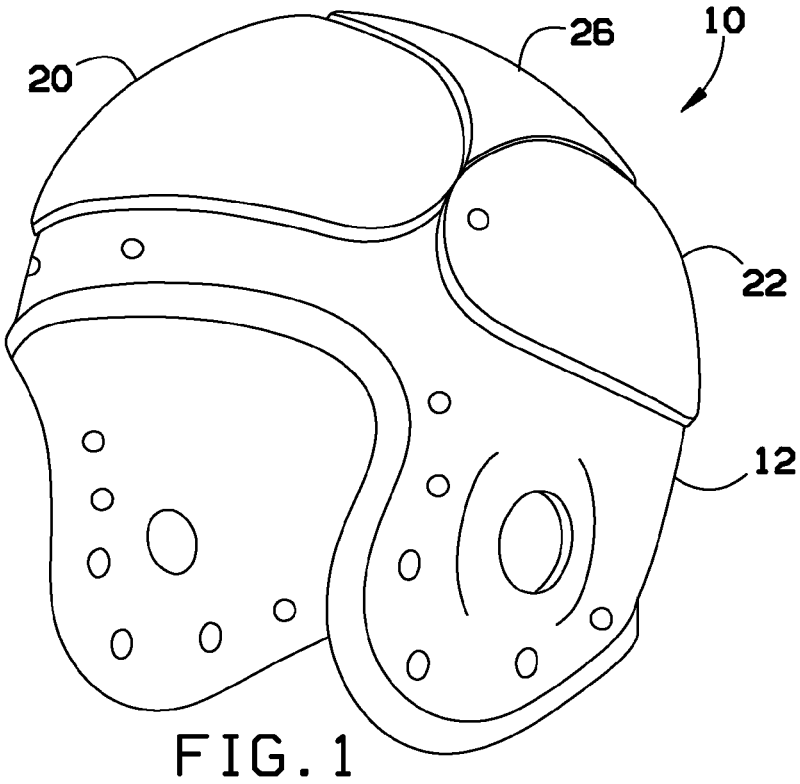
FIG. 1 is a perspective view of a helmet according to an exemplary embodiment of the present invention.
Figure 2:
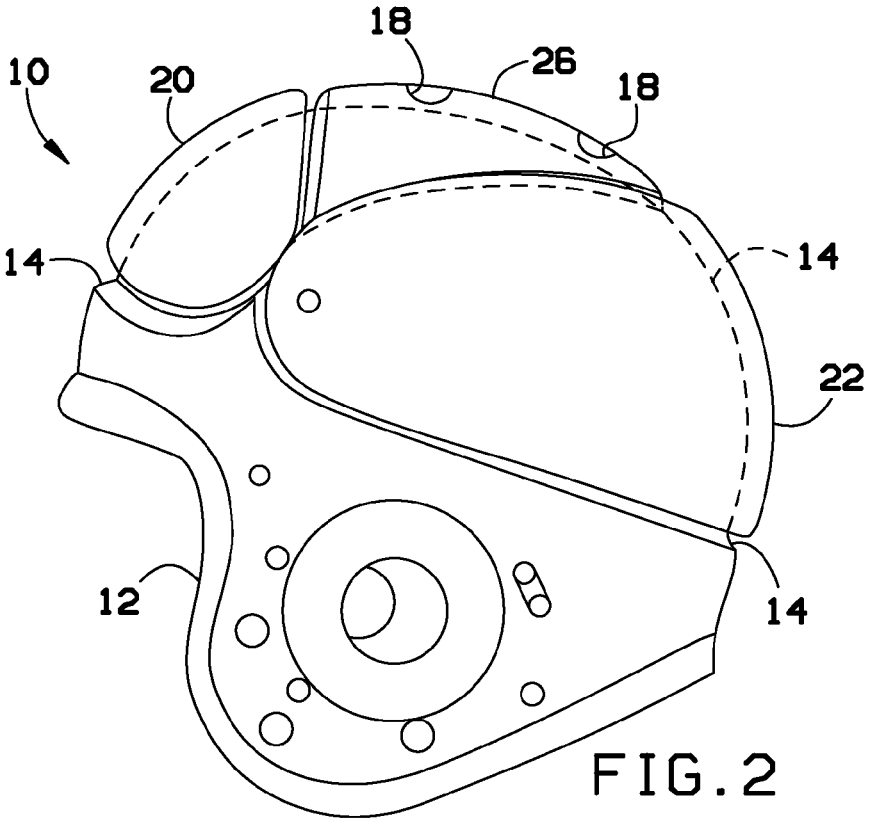
FIG. 2 is a left side view of the helmet of FIG. 1.
Figure 3:
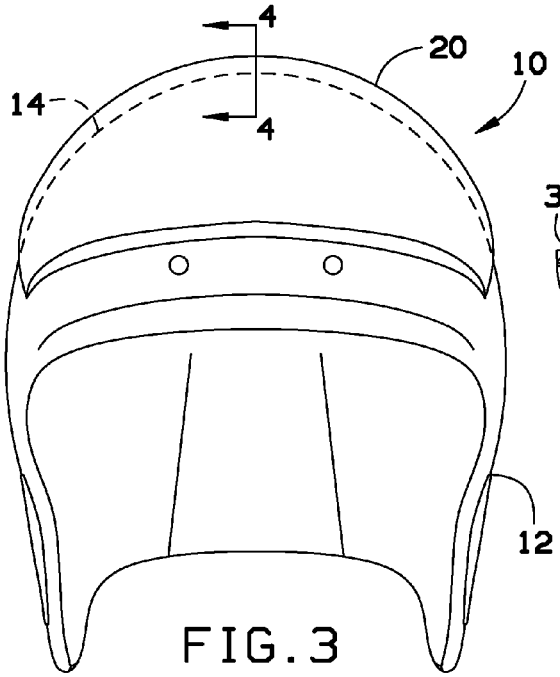
FIG. 3 is a front view of the helmet of FIG. 1.

Referring to FIGS. 1 through 5, a helmet system 10 may include a helmet 12 having a plurality of distinct recessed insert surfaces 14. For example, five recessed insert surfaces (each generally labeled as recessed insert surfaces 14) may be configured on the exterior surface 30 of the helmet 12. A front insert 20 may fit into a front recessed surface, a left side insert 22 may fit into a left side recessed insert surface, a right side insert 24 may fit into a right side recessed insert surface, a top insert 26 may fit into a top recessed insert surface, and a back insert 28 may fit into a back recessed insert surface. In some embodiments, the recessed insert surfaces 14 may touch adjacent recessed insert surfaces 14, such that inserts may contact each other when disposed in the recessed insert surfaces 14. For example, as shown in FIG. 2, the left side insert 22 may be disposed adjacent the front insert 20, and these inserts 22, 20 may touch each other along at least one portion thereof.

The inserts (or pads) 20, 22, 24, 26, 28 may be made out of shock absorbent material. In one embodiment, the pads may be made of foam, rubber, gel, plastic, polymer, or light foam. In one embodiment, the pads 20, 22, 24, 26, 28 may have a slippery shiny surface.

Figure 4:
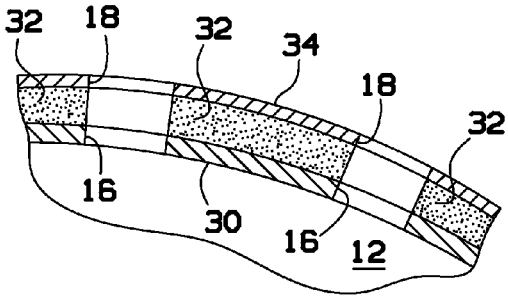
FIG. 4 is a cross-sectional view taken along line 4-4 of FIG. 3.
Figure 5:
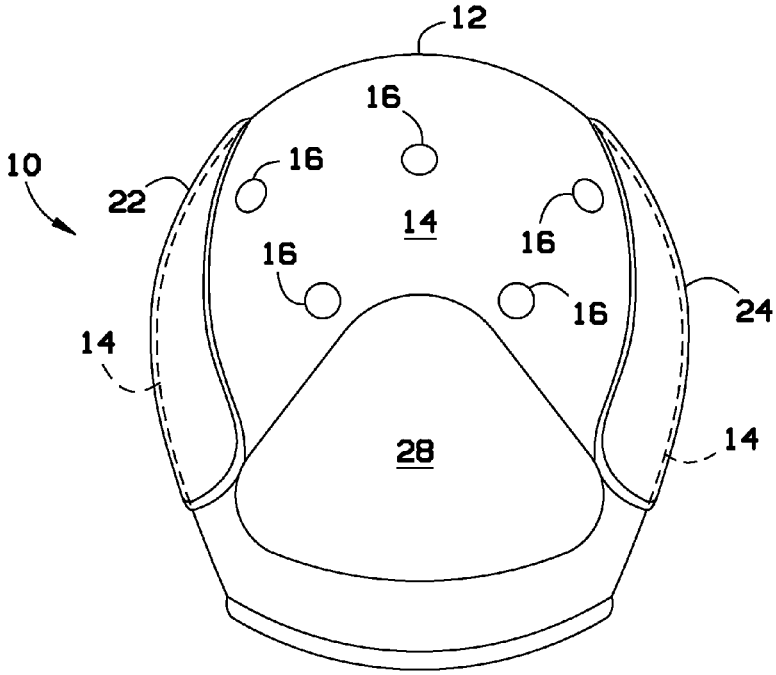
FIG. 5 is a rear view of the helmet of FIG. 1.

Helmet ventilation holes 16 may be disposed at various locations in the helmet, as may be conventional in the art. Insert ventilation holes 18 may be disposed through the inserts. For example, as shown in FIG. 4, the helmet ventilation holes 16 may align with the padding ventilation holes 18 so that air may circulate between the interior and the exterior of the helmet.

An outer finish 34 may cover an exterior of the helmet 12 (except for the ventilation holes 16, 18. The outer finish 34 may be a smooth, hard finish, similar in visual appearance to conventional helmets. In other words, from an aesthetic perspective, the helmet system 10 of the present invention may appear the same or similar to conventional helmets.

The recessed surfaces 14 may be recessed from about ⅛ inch to about ¼ inch, typically about 3/16 inch. Therefore, the inserts 20, 22, 24, 26, 28 may have a thickness that is the same as the depth of the recessed surfaces 14. For example, the recessed surfaces 14 may have a depth of about 3/16 inch and the inserts 20, 22, 24, 26, 28 may have a thickness of 3/16 inch.

Figure 6:
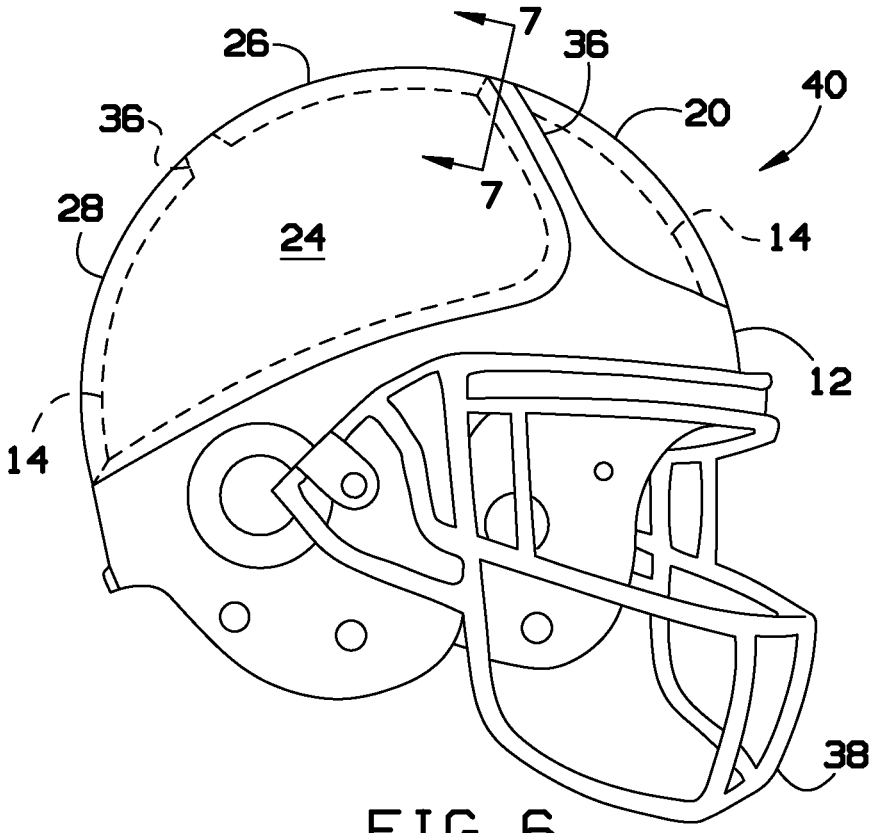
FIG. 6 is a perspective view of a helmet according to another exemplary embodiment of the present invention.
Figure 7:
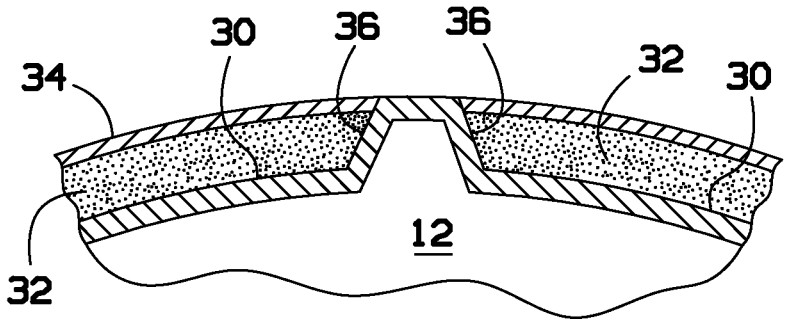
FIG. 7 is a cross-sectional view taken along line 7-7 of FIG. 6.

Referring now to FIGS. 6 and 7, a helmet system 40 may include a space between the recessed surfaces 14. The space may be defined by a tapered divider 36. The tapered divider 36 may have a taper from about 10 to about 45 degrees from perpendicular. The inserts 20, 22, 24, 26, 28 may have a corresponding taper such that the inserts fit into each of the recessed surfaces, as shown, for example, in FIG. 7. Similar to the embodiment of FIGS. 1 through 5, the inserts may fit into the recessed surfaces to form a substantially uniform outer surface of the helmet. This outer surface may be covered with the outer finish 34, as described above. In some embodiments, the tapered divider 36 may have a height that is the same as the thickness of the insert plus the outer finish 34, as shown in FIG. 7. In other embodiments, the tapered divider 36 may have a height that is the same as the thickness of the insert alone. In this embodiment, the outer finish 34 may cover not only the inserts, but also the top portions of the tapered divider 36.

The helmet 12 may be used in various sports. For example, the helmet may be used in baseball, football, cycling, skateboarding, roller blading, and the like. The helmet may include other conventional features, such as a face guard 38, for example. The helmet 12 may also be useful for special needs uses and for safety for persons with various illnesses.

It should be understood, of course, that the foregoing relates to exemplary embodiments of the invention and that modifications may be made without departing from the spirit and scope of the invention as set forth in the following claims.

What is claimed is:

1. A helmet having an interior adapted to face the wearer and an exterior facing away from the wearer when worn, said helmet comprising:

an outer surface;

a front recessed surface formed on said outer surface;

a front outer pad coupled to said front recessed surface;

a top recessed surface formed on said outer surface;

a top outer pad coupled to said top recessed surface;

a back recessed surface formed on said outer surface;

a back outer pad coupled to said back recessed surface;

a left recessed surface formed on said outer surface;

a left outer pad coupled to said left recessed surface;

a right recessed surface formed on said outer surface;

a right outer pad coupled to said right recessed surface; and at least one first ventilation hole in said outer surface and at least one second ventilation hole in said outer pads;

said at least one first ventilation hole being aligned with said at least one second ventilation hole so that air is exchanged between said interior and said exterior of the helmet.

2. The helmet of claim 1, wherein said outer pads are disposed at least partially adjacent to each other.

3. The helmet of claim 1, further comprising:

at least one tapered divider between said recessed surfaces.

4. The helmet of claim 1, wherein said outer pads are constructed from foam, rubber, gel, plastic, polymer, or light foam.

5. The helmet of claim 1, further comprising:

an exterior layer disposed on an outer surface of said outer pads that provides a smooth exterior surface of the helmet.

6. The helmet of claim 5, further comprising:

at least one third ventilation hole in said exterior layer;

said at least one third ventilation hole in said exterior layer being aligned with said at least one first ventilation hole and said at least second ventilation hole so that air is exchanged between said interior and said exterior of the helmet.

* * * * *